US011541443B2

(12) United States Patent
Cho et al.

(10) Patent No.: US 11,541,443 B2
(45) Date of Patent: Jan. 3, 2023

(54) APPARATUS FOR FORMING ATYPICAL CURVED PANEL AND METHOD FOR FORMING ATYPICAL CURVED PANEL USING SAME

(71) Applicant: Yoochang Co., Ltd., Gyeonggi-do (KR)

(72) Inventors: Yong-Sun Cho, Seoul (KR); In Heo, Gyeonggi-do (KR)

(73) Assignee: Yoochang Co., Ltd, Seoul (KR)

( * ) Notice: Subject to any disclaimer, the term of this patent is extended or adjusted under 35 U.S.C. 154(b) by 175 days.

(21) Appl. No.: 17/055,571

(22) PCT Filed: Nov. 12, 2018

(86) PCT No.: PCT/KR2018/013681
§ 371 (c)(1),
(2) Date: Nov. 14, 2020

(87) PCT Pub. No.: WO2019/221347
PCT Pub. Date: Nov. 21, 2019

(65) Prior Publication Data

US 2021/0213508 A1 Jul. 15, 2021

(30) Foreign Application Priority Data

May 14, 2018 (KR) ..... 10-2018-0054906

(51) Int. Cl.
*B21D 11/20* (2006.01)
*B21D 37/10* (2006.01)

(52) U.S. Cl.
CPC ..... *B21D 11/203* (2013.01); *B21D 37/10* (2013.01)

(58) Field of Classification Search
CPC ..... B21D 11/20; B21D 11/203; B21D 37/10
See application file for complete search history.

(56) References Cited

U.S. PATENT DOCUMENTS 4,212,188 A * 7/1980 Pinson ..... B21D 5/01 72/413

FOREIGN PATENT DOCUMENTS

| | | | | |
|---|---|---|---|---|
| JP | H0732069 A | 2/1995 | | |
| KR | 10-0794110 B1 | 1/2008 | | |
| KR | 101203092 B1 | * 11/2012 | ..... | B21D 13/02 |
| KR | 10-1562037 B1 | 10/2015 | | |
| KR | 10-1621239 B1 | 2/2016 | | |
| KR | 2017-0022128 | 3/2017 | | |

* cited by examiner

*Primary Examiner* — Debra M Sullivan
(74) *Attorney, Agent, or Firm* — Howson & Howson LLP

(57) ABSTRACT

The present invention relates to an atypical curved panel forming apparatus and, more specifically, to an atypical curved panel forming apparatus having a novel structure, comprising: a mold block 20 enabling a panel A to be formed to be put on the upper surface thereof; and a pressing means 30 positioned on the upper side of the middle portion of a conveyor device 12 so as to downwardly press the panel A put on a mold, thereby pressing the entire panel A so as to enable the entire panel A to be pressed at constant pressure, enabling the time required for forming the panel A to be minimized, and enabling the atypical curved panel put on the mold block 20 to be effectively formed.

4 Claims, 13 Drawing Sheets

APPARATUS FOR FORMING ATYPICAL CURVED PANEL AND METHOD FOR FORMING ATYPICAL CURVED PANEL USING SAME

CROSS-REFERENCE TO RELATED APPLICATIONS

This application is a national stage application based upon International Application No. PCT/KR2018/03681, and claims priority on the basis of Korean Patent Application No. 10-2018-0054906, filed on May 14, 2018. The disclosure of International patent application No. PCT/KR2018/03681 is here incorporated by reference.

FIELD OF THE INVENTION

The present invention relates to an atypical curved panel forming apparatus and, more specifically, to an atypical curved panel forming apparatus having a novel structure, comprising: a mold block 20 enabling a panel A to be formed to be put on the upper surface thereof; and a pressing means 30 positioned on the upper side of the middle portion of a conveyor device 12 so as to downwardly press the panel A put on a mold, thereby pressing the entire panel A so as to enable the entire panel A to be pressed at constant pressure, enabling the time required for forming the panel A to be minimized, and enabling the atypical curved panel put on the mold block 20 to be effectively formed.

BACKGROUND OF THE INVENTION

Recently, the outer surface of a building finished with panels made of various materials such as iron or aluminum or glass etc. is increased.

Further, as the building is constructed in a complex geometric shape, the shape of the panel is also manufactured in an irregular curved shape, depending on the shape of the building.

FIGS. 1 and 2 show a conventional atypical curved panel forming apparatus which is used when molding panel to the irregular atypical curved shape. It includes a conveyor device 1 which is extended in a lateral direction, a mold block 2 which is transferred by the conveyor device 1 and puts a panel A to be formed on the upper side, and a pressing unit 3 which is located on the upper side of the middle part of the conveyor device 1 and presses the panel A mounted on the mold to the lower side.

The mold block 2 is made of a metal material such as aluminum, and the upper surface is formed in the form of an atypical curved surface for forming the panel A.

The pressing means 3 is comprised of the support frame 3*a* which is placed on the upper side of a mold transferred by the conveyor device 1, the platform 3*b* which is movably coupled to the a support frame 3*a* and lifted by a lifting driving unit 3*c*, the lifting bar 3*d* which is movably coupled to the platform 3*b* and is pressed downward by a spring 3*e*, and the pressing roller 3*f* which is provided at the lower end of the lifting bar 3*d*, and comes into close contact with the upper surface of the panel A mounted on the upper surface of the mold block 2.

At this time, the lifting bar 3*d* and the pressing roller 3*f* are configured such that a plurality of the lifting bar 3*d* and the pressing roller 3*f* are aligned in a lateral direction.

Therefore, after the panel A heated to the proper temperature is placed on the upper surface of the mold block 2, the mold block 2 is moved rearward by using the conveyor device 1, and when the platform 3*b* is lowered, the pressing roller 3*f* presses the panel A downward to deform the panel A to correspond to the shape of the upper surface of the mold block 2.

When the mold block 2 is moved further backward, the panel A is pressed into the curved shape corresponding to the shape of the upper surface of the mold block 2 while the lifting bar 3D is properly lifted according to the curvature of the upper surface of the mold block 2, and finally, the amorphous curved panel formed in the shape of the upper surface of the mold block 2 can be manufactured.

The detailed construction and operation of the atypical curved panel forming apparatus is described in detail in Korean Patent No. 10-1203092, and thus a detailed description thereof will be omitted.

However, when the panel A mounted on the upper surface of the mold block 2 is pressed downward, the panel A is transformed into the shape of the upper surface of the mold block 2 while the panel A mounted on the upper surface of the mold block 2 is pressed downward, so that it is difficult to press the entire panel A with a constant force, and thus it is difficult to manufacture an atypical curved panel having a precise shape.

In order for the panel A to be accurately formed in the shape of the upper surface of the mold block 2, the mold block 2 must be moved slowly, thereby resulting in a lot of time.

In addition, in order to prevent the heated panel A mounted on the upper surface of the mold block 2 from being cooled when it takes time to form the panel A, it is necessary to have a chamber for preventing the panel A from being cooled on the circumference of the pressing means 3, thereby increasing the cost of the atypical curved panel forming apparatus.

Accordingly, there is a need for a new method that can solve this problem.

SUMMARY OF THE INVENTION

Technical Problem

The present invention is derived to solve the problems, and more specifically, an object of the present invention is to provide an apparatus for forming an atypical curved panel of a new structure which can minimize the time required for forming the panel A and effectively mold an atypical curved panel placed on the mold block 20 by pressurizing the whole panel A with a constant pressure by pressing the whole panel A, which is comprising of the mold block 20 and the pressing unit 30. The molding block 20 can put the panel A molded on the upper side and the pressing unit 30 is located in the middle portion upper side of the conveyor system 12 and pressurizes the panel A put on the mold to the lower side.

Technical Solution

To achieve the above purpose, the present invention provides the apparatus for forming an atypical curved panel in which it include a mold block 20 configured to put a panel A to be formed on an upper surface, and a pressing unit 30 located on the upper side of the middle portion of the conveyor device 12 and pressing the panel A mounted on the mold to the lower side. The upper surface of the mold block 20 is formed in the form of an atypical curved surface for forming the panel A, and the pressing means 30 is comprised of a support 31 positioned above the mold block 20, a plurality of cylinder tools 32 provided on the support 31 to allow the piston rod 32*a* extending downward and configured to lift the piston rod 32*a* by pneumatic or hydraulic pressure, a pressing member 33 provided at the lower end of the piston rod 32*a* of the cylinder tools 32. The cylinder tools 32 are provided to be spaced apart from each other in the fore and aft and left and right directions, when the piston rod 32*a* is lowered, the pressing member 33 presses the panel A mounted on the upper surface of the mold block 20 to be in close contact with the upper surface of the mold block 20, so that the panel A is formed in the shape of the upper surface of the mold block 20.

According to another aspect of the present invention, the panel A is heated by passing through the heating furnace 11 while the panel A is mounted on the upper surface of the mold block 20, and is supplied to the lower side of the pressing means 30 by the conveyor device 12.

According to another aspect of the present invention, a spherical ball head 32*b* is provided at the lower end of the piston rod 32*a*, the ball head 32*b* is provided with the through-hole 32*c* passing through the peripheral surface. A pressing member 33 is comprised of a rectangular pressing plate 33*a* extended in the front and rear direction; an extended pipe body 33*b* extended upward from the upper surface of the pressing plate 33*a* and into which the ball head 32*b* is inserted; and a fixing pin 33*c* penetrating the through-hole 32*c* of the ball head 32*b* and having both ends fixed to the extension pipe 33*b* so that the pressing member 33 can be freely tilted forward and backward and left and right.

According to another aspect of the present invention, there is provided an apparatus for forming an atypical curved panel, wherein the lower side of the pressing plate 33*a* is configured to have an arcuate shape in which the middle portion protrudes downward, and the extension pipe body 33*b* is positioned to be close to the proximal end of the pressing plate so that the front end portion of the pressing member 33 is rotated downward when the piston rod is lifted.

According to still another aspect of the present invention, there is provided an apparatus for forming an atypical curved panel, wherein the through-hole 32*c* is formed in a slot hole type shape extending in a vertical direction, and the diameter of the fixing pin 33*c* is configured to correspond to the front and rear width of the through-hole 32*c*, so that the pressing member 33 is not rotated in a lateral direction while being inclined in the front and rear and left and right directions.

According to another aspect of the present invention, there is provided a method for forming an atypical curved panel using an atypical curved panel molding apparatus as described above. The method comprises the steps of: the step of placing the panel A on the upper surface of the mold block 20; the step of supplying the panel A placed on the molding block 20 to the heating furnace 11 and heating; the step of supplying the mold block 20 and the panel A heated in the heating furnace 11 to the lower side of the pressing unit 30 by using the conveyor apparatus 12; the step of forming the panel A by operating the cylinder tools 32 of the pressing unit 30 and descending the pressurization member 33 so as to press the panel A to be in contact with the upper surface of a mold block 20; the step of discharging the panel A and the mold block 20 rearward using the conveyor device 12 after the pressing member 33 is lifted by the cylinder tool 32, and air-cooling the discharged mold block 20 and the panel A in air.

According to another aspect of the present invention, a space 21 is formed in the mold block 20, and a plurality of suction holes 22 connected to the space 21 are formed on the upper surface of the space 21. The present invention further comprises the vacuum pump 50 which is connected to the space 21 through the exhaust pipe 40 and inhales the air on the upper surface of the mold block 20 through the space 21 and the inlet hole 22, an air pressure sensor 60 provided at an intermediate portion of the exhaust pipe 40 to measure air pressure inside the exhaust pipe 40, an exhaust valve 70 provided at an intermediate portion of the exhaust pipe 40 to open and close an intermediate portion of the exhaust pipe 40, and a control means 80 for receiving a signal from the pressure sensor 60 and controlling the operation of the vacuum pump 50 and the exhaust valve 70. The exhaust pipe 40 is composed of the fixing pipe part 41 made of metal material and fixed to one side of the mold block 20 so as to be connected to the space 21; the intermediate pipe part 42 detachably connected to the outer end of the fixing pipe part 41 and including an air pressure sensor 60 and an exhaust valve 70 in the middle part; and the connection pipe part 43 detachably coupled to the outer end of the fixing pipe part 41 and connected to the vacuum pump 50. When the panel A mounted on the mold block 20 is pressed and molded using the pressing unit 30, the control unit 80 drives the vacuum pump 50 to discharge the air on the upper side of the mold block 20 to the outside, so that the panel A is adsorbed and fixed on the upper surface of the mold block 20 by the pressing unit 30, when the air pressure inside the exhaust pipe 40 measured by the atmospheric pressure sensor 60 is lowered below a preset vacuum pressure, the above control means 80 controls the exhaust valve 70 to seal the middle portion of the intermediate pipe portion 42 and stops the operation of the vacuum pump 50. When the mold block 20 and the panel A heated, the intermediate tube portion 42 and the connection pipe section 43 are separated, when pressing and molding the panel A with the pressing means 30, the intermediate tube portion 42 and the connection pipe section 43 are connected to the fixing tube part 41 so as to discharge the upper air of the mold block 20, when the molding process of the panel A is completed and it cools the panel A, the connection pipe section 43 is only separated and the state where the panel A is absorbed and fixed in the upper side of the mold block 20 with the vacuum pressure is maintained, and the intermediate pipe unit 42 is opened by controlling the exhaust valve 70 after the panel A is completely cooled, and the outside air is introduced into the space unit 21 through the intermediate pipe unit 42 and the fixing pipe unit 41 to separate the panel A.

The description of the techniques disclosed herein, on the other hand, is merely an example of a structural or functional description, and thus the scope of the disclosed technology should not be construed as limited by the embodiments set forth herein. That is, it is to be understood that the embodiments are capable of various modifications and various forms, and that the scope of the disclosed technology includes equivalents to those skilled in the art to realize the technical spirit.

Also, it is to be understood that the scope of the disclosed technology should not be construed as limited thereby, since the purpose or effect presented in the disclosed technology is not meant to include all or all of the specific embodiments.

Also, the meaning of the term described in the present design should be understood as follows. The terms "first," "second" and the like are intended to distinguish one element from another, and should not be limited by these terms. For example, a first component can be termed a second component and, similarly, can be termed a first component as a second component.

It will further be understood that, when an element is referred to as being "coupled to" another element, it may be directly coupled to the other element, or intervening elements may also be present. In contrast, when an element is referred to as being "directly connected to" another element, there are no intervening elements present. Other representations that describe the relationship between elements, on the other hand, should likewise be interpreted as "between" and "between" and "adjacent" or "directly neighboring".

It is to be understood that the terms "comprises," "includes," or the like, are intended to include a plurality of representations unless the context clearly dictates otherwise, and it is to be understood that the terms "comprises," "includes," or combinations thereof, are intended to be inclusive and do not preclude the presence or addition of one or more other features or numbers, steps, operations, components, parts, or combinations thereof.

Unless defined otherwise, all terms used herein have the same meaning as commonly understood by one of ordinary skill in the art to which this invention belongs. It is to be understood that the terms defined in general terms are intended to be consistent with their meaning in the context of the relevant art and are not to be interpreted as having an idealized or overly formal meaning unless expressly so defined herein.

Advantageous Effects

The apparatus for forming an atypical curved panel according to the present invention comprises a mold block 20 configured to put a panel A to be formed on an upper surface, and a pressing unit 30 located on the upper side of the middle portion of the conveyor device 12 and pressing the panel A mounted on the mold to the lower side. The upper surface of the mold block 20 is formed in the form of an atypical curved surface for forming the panel A, and the pressing means 30 is comprised of a support 31 positioned above the mold block 20, a plurality of cylinder tools 32 provided on the support 31 to allow the piston rod 32*a* extending downward and configured to lift the piston rod 32*a* by pneumatic or hydraulic pressure, a pressing member 33 provided at the lower end of the piston rod 32*a* of the cylinder tools 32. The cylinder tools 32 is provided to be spaced apart from each other in the fore and aft and left and right directions, when the piston rod 32*a* is lowered, the pressing member 33 presses the panel A mounted on the upper surface of the mold block 20 to be in close contact with the upper surface of the mold block 20, so that the panel A is formed in the shape of the upper surface of the mold block 20.

Therefore, the entire panel A can be pressed at a time, so that the entire panel A can be pressurized with a constant pressure, and the time required for forming the panel A can be minimized.

DETAILED DESCRIPTION OF THE BEST MODE

Figure 1:
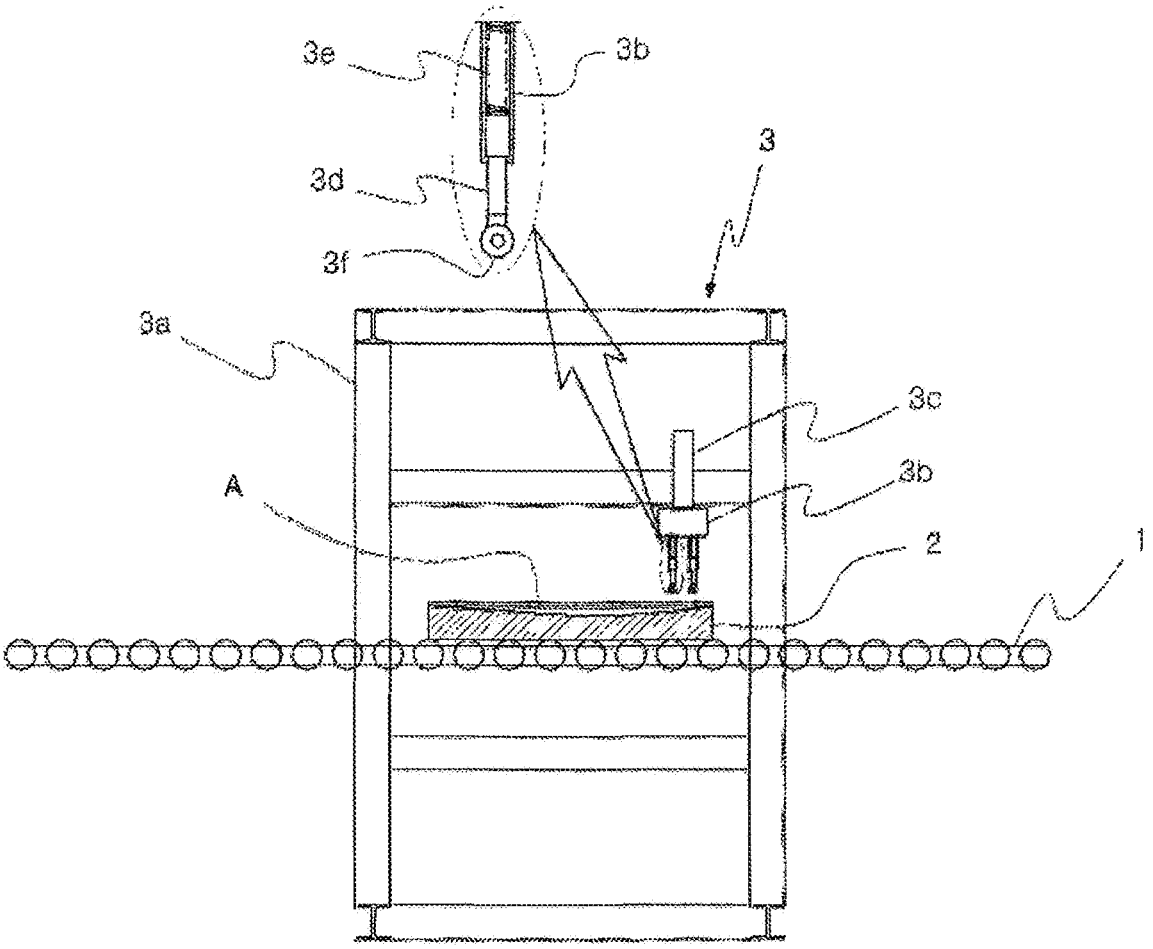
FIG. 1 (PRIOR ART)
FIG. 1 is a cross-sectional view of a conventional atypical curved panel forming apparatus.
Figure 2:
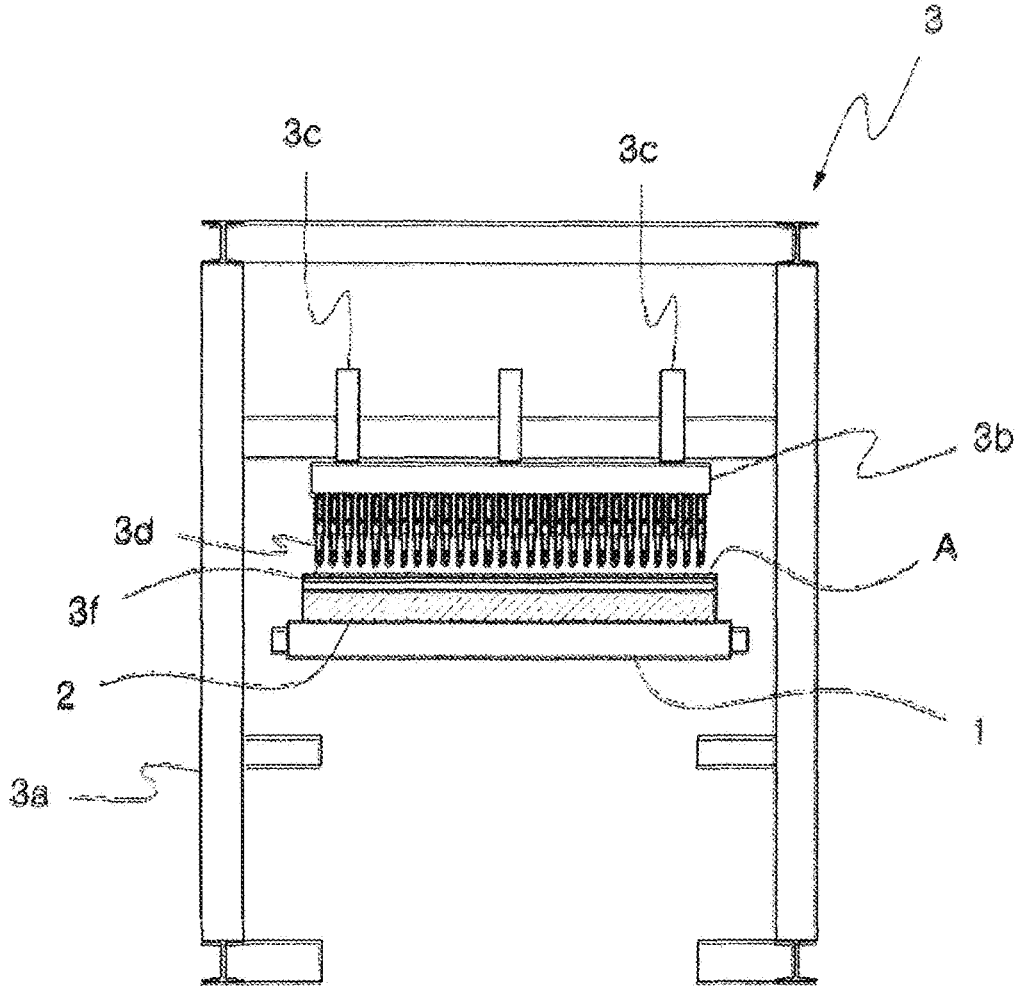
FIG. 2 (PRIOR ART)
FIG. 2 is a front cross-sectional view of a conventional atypical curved panel forming apparatus.

The apparatus comprises: a mold block 20 which is configured to lift a panel A to be formed on an upper surface and is transferred by a conveyor device 12; a pressing unit 30 which is located on the upper side of the middle portion of the conveyor device 12 and presses the panel A mounted on the mold to the lower side, and the upper surface of the mold block 20 is formed in the form of an atypical curved surface for forming the panel A. The pressing means 30 is comprising of a support 31 positioned above the mold block 20; a plurality of cylinder tools 32 are provided on the support 31 to allow the piston rod 32*a* to extend downward and are configured to lift the piston rod 32*a* by pneumatic or hydraulic pressure; a pressing member 33 provided at the lower end of the piston rod 32*a* of the cylinder tools 32, and the cylinder tools 32 is provided to be spaced apart from each other in the fore and aft and left and right directions.

When the piston rod 32*a* is lowered, the pressing member 33 presses the panel A mounted on the upper surface of the mold block 20 to be in close contact with the upper surface of the mold block 20, so that the panel A is formed in the shape of the upper surface of the mold block 20, a spherical ball head 32*b* is provided at a lower end of the piston rod 32*a*, the ball head 32*b* is provided with a through hole 32*c* passing through both sides thereof.

The above pressing member 33 is comprised of a rectangular pressing plate 33*a* extended in the forward and backward direction; an extended pipe body 33*b* is extended upward from the upper surface of the pressing plate 33*a* and into which the ball head 32*b* is inserted; a fixing pin 33*c* passes through the through hole 32*c* of the ball head 32*b* and has both ends fixed to the extension pipe 33*b*.

Accordingly, the apparatus for forming an atypical curved panel is characterized in that the pressing member 33 can be freely tilted forward and backward and left and right directions.

Modes of the Invention

Hereinafter, the present invention will be described in detail with reference to the accompanying drawings.

Figure 3:
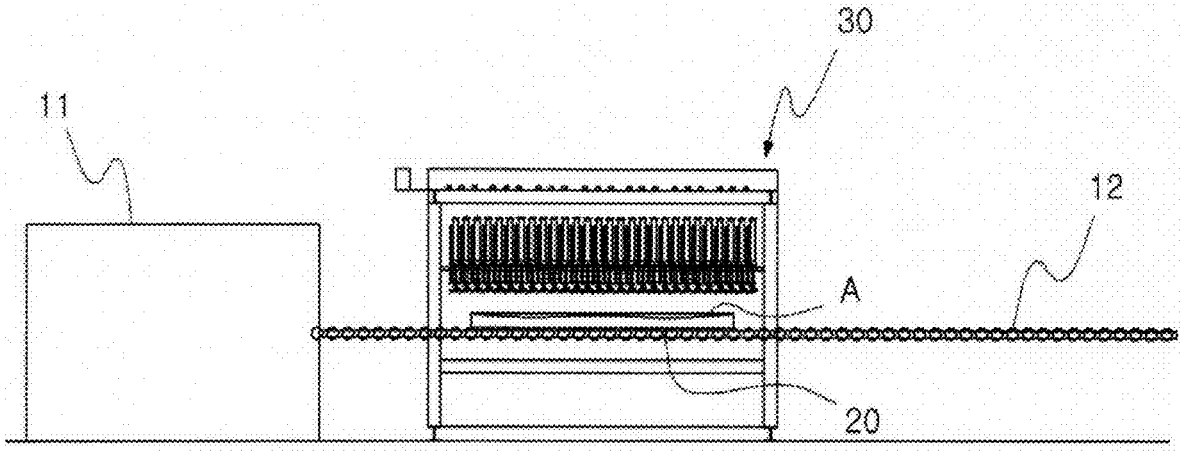
FIG. 3 is a side view of an atypical curved panel forming apparatus according to the present invention.
Figure 4:
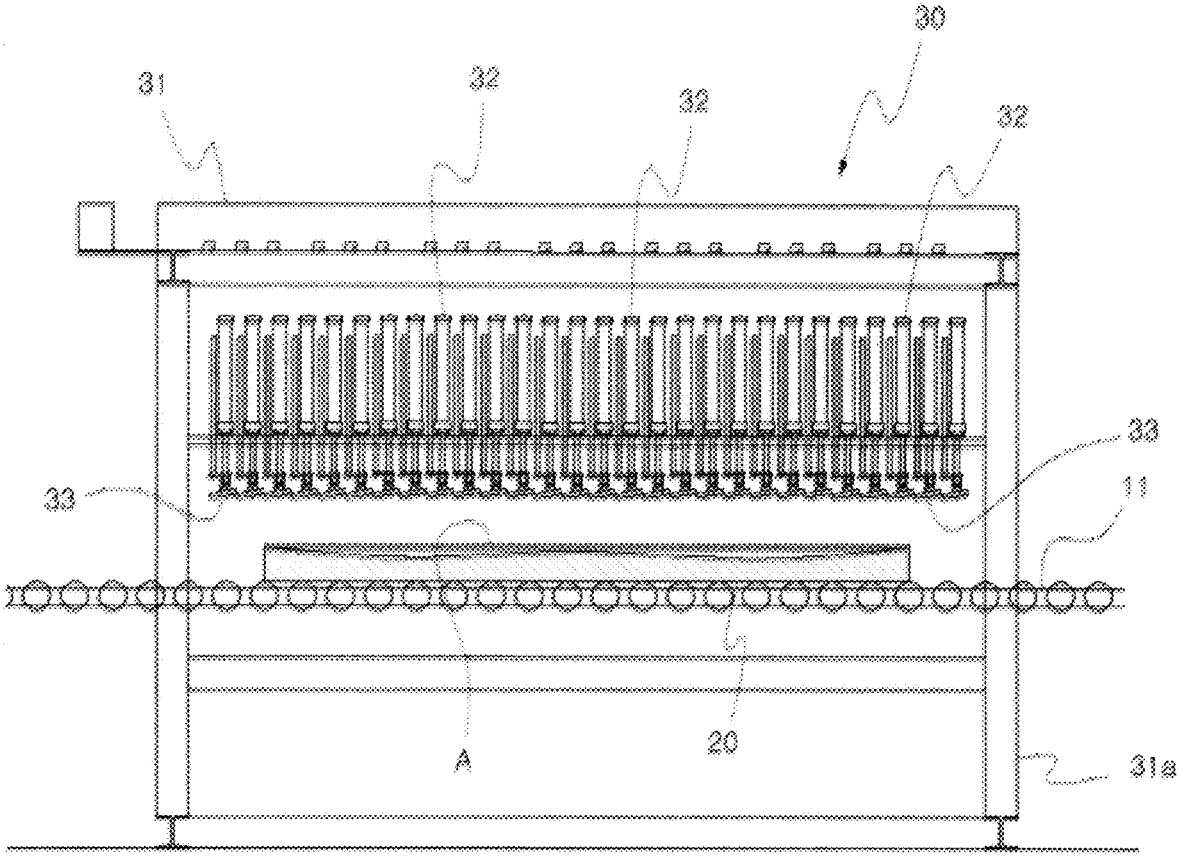
FIG. 4 is a side view of a portion of an atypical curved panel forming apparatus according to the present invention.
Figure 5:
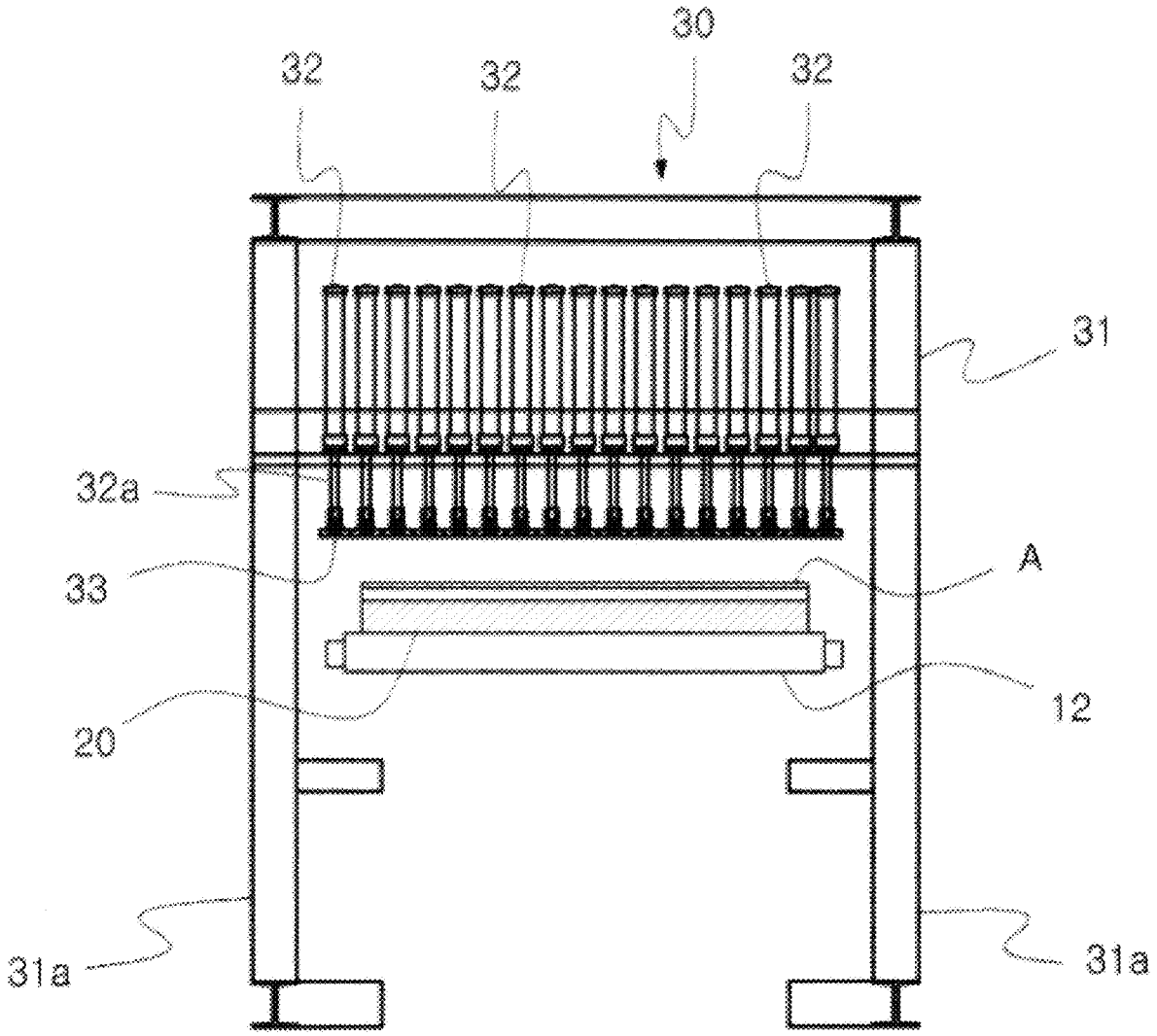
FIG. 5 is a front cross-sectional view of a portion of an atypical curved panel forming apparatus according to the present invention.

FIG. 3 shows an atypical curved panel forming apparatus according to the present invention, which is used to form a panel A made of a material such as iron or aluminum or glass used for finishing the outer surface of a building into an atypical curved surface.

According to the present invention, the apparatus for forming an atypical curved panel according to the present invention comprises: a mold block 20 capable of putting a panel A to be formed on an upper surface; and a pressing means 30 placed on the upper side of the middle part of the conveyor device 12 to press the panel A mounted on the mold to the lower side.

The mold block 20 is formed in the form of a square block made of aluminum, and the upper surface is formed in the form of an irregular curved surface to form the panel A.

Then, in the front of the pressing means 30, a heating furnace 11 capable of heating the mold block 20 and the panel A mounted on the upper surface of the above mold block 20 is provided, and a conveyor device 12 is provided at the rear of the heating furnace 11 to transfer the mold block 20 and the panel A discharged from the heating furnace 11, wherein the mold block 20 and the panel A heated in the heating furnace 11 are transferred to the rear side by the conveyor device 12.

As shown in FIGS. 4 to 7, the pressing means 30 is comprised of the support 31 located in the upper side of the rearwards transferred mold block 20, a plurality of cylinder tools 32 are provided on the support 31 to allow the piston rod 32*a* to extend downward and are configured to lift the piston rod 32*a* by pneumatic or hydraulic pressure, and a pressing member 33 provided at the lower end of the piston rod 32*a* of the cylinder tools 32. When the piston rod 32*a* is lowered, the pressing member 33 presses the panel A mounted on the upper surface of the mold block 20 to be in close contact with the upper surface of the mold block 20, so that the panel A is formed in the shape of the upper surface of the mold block 20.

The support 31 is constructed by combining a metal bar and a metal plate having a high strength, and is positioned above an intermediate portion of the conveyor apparatus 12 by a vertical bar 31*a* an extending downward from the circumference thereof.

The cylinder tool 32 uses a hydraulic cylinder or a pneumatic cylinder provided to extend in a vertical direction, and a plurality of the cylinder tool 32 are provided on the support 31 so as to be in a row and a lateral direction.

Then the cylinder tool 32 is divided into a plurality of groups so that only a part of the cylinder tool 32 can be selectively extended according to the size of the panel A mounted on the mold block 20.

A spherical ball head 32*b* is provided at the lower end of the piston of the cylinder tool 32, and a through-hole 32*c* passing through the circumferential surface is formed in the ball head 32*b*.

Figure 8:
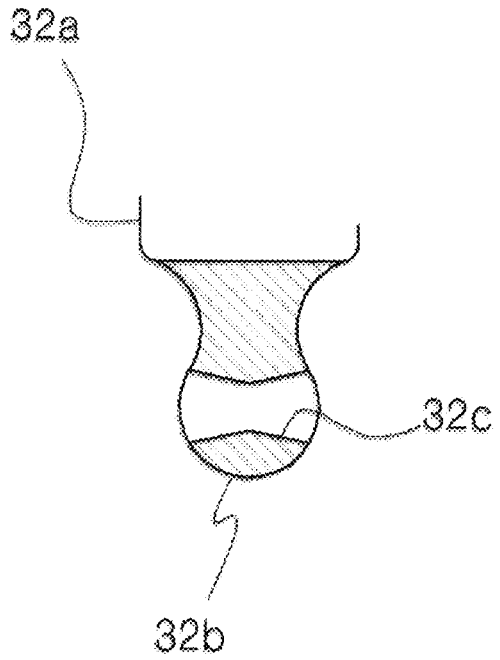
FIG. 8 is a cross-sectional side view of a through hole formed in a cylinder mechanism of an atypical curved panel forming apparatus according to the present invention.

As shown in FIG. 8, the through hole 32*c* has a slot hole type shape extending in a vertical direction while passing through the ball head 32*b* in the forward and backward directions.

Then the through hole 32*c* is configured such that the width of the middle portion is narrowed.

Figure 6:
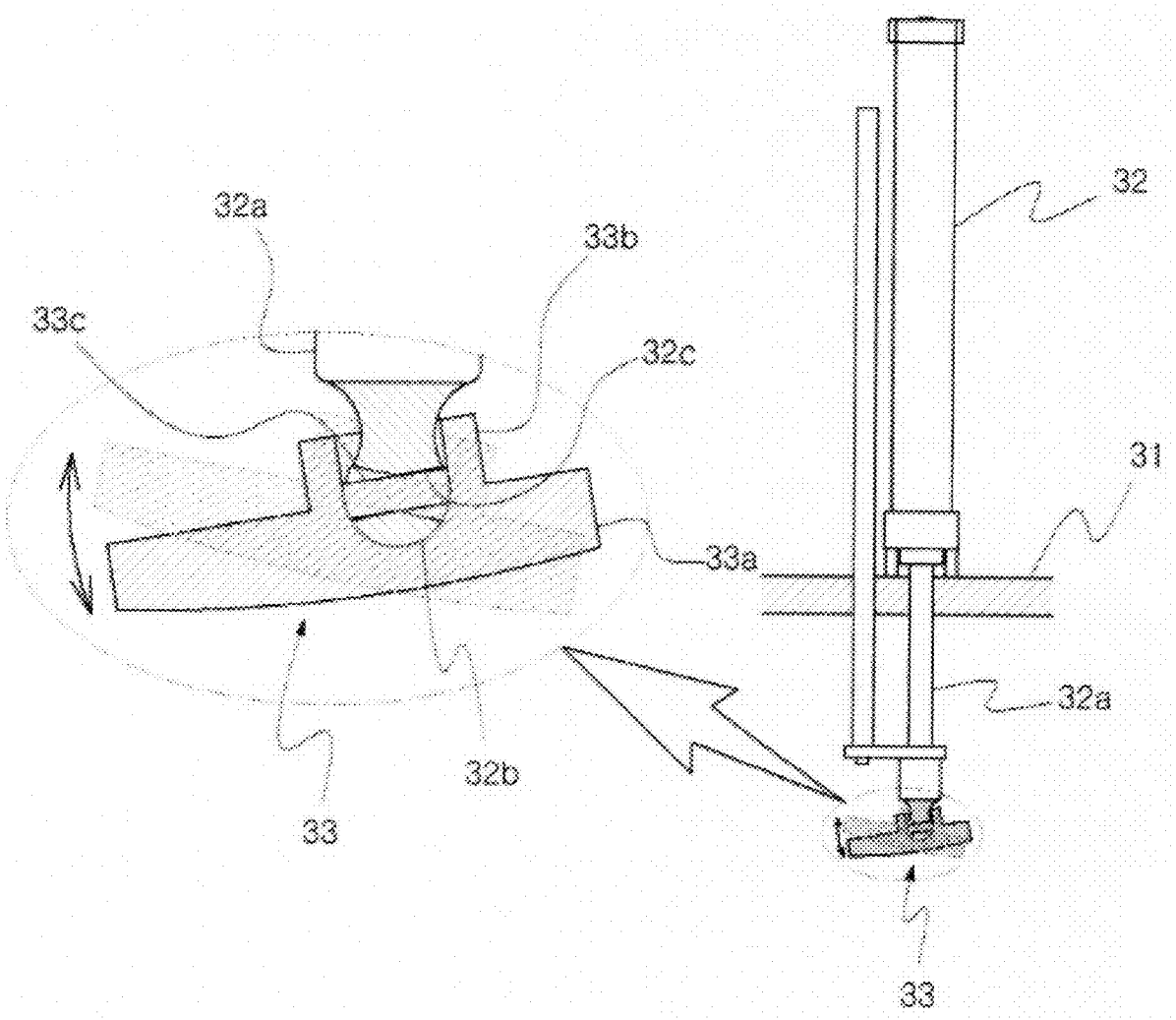
FIG. 6 is a cross-sectional side view showing a pressing means of an atypical curved panel forming apparatus according to the present invention.
Figure 7:
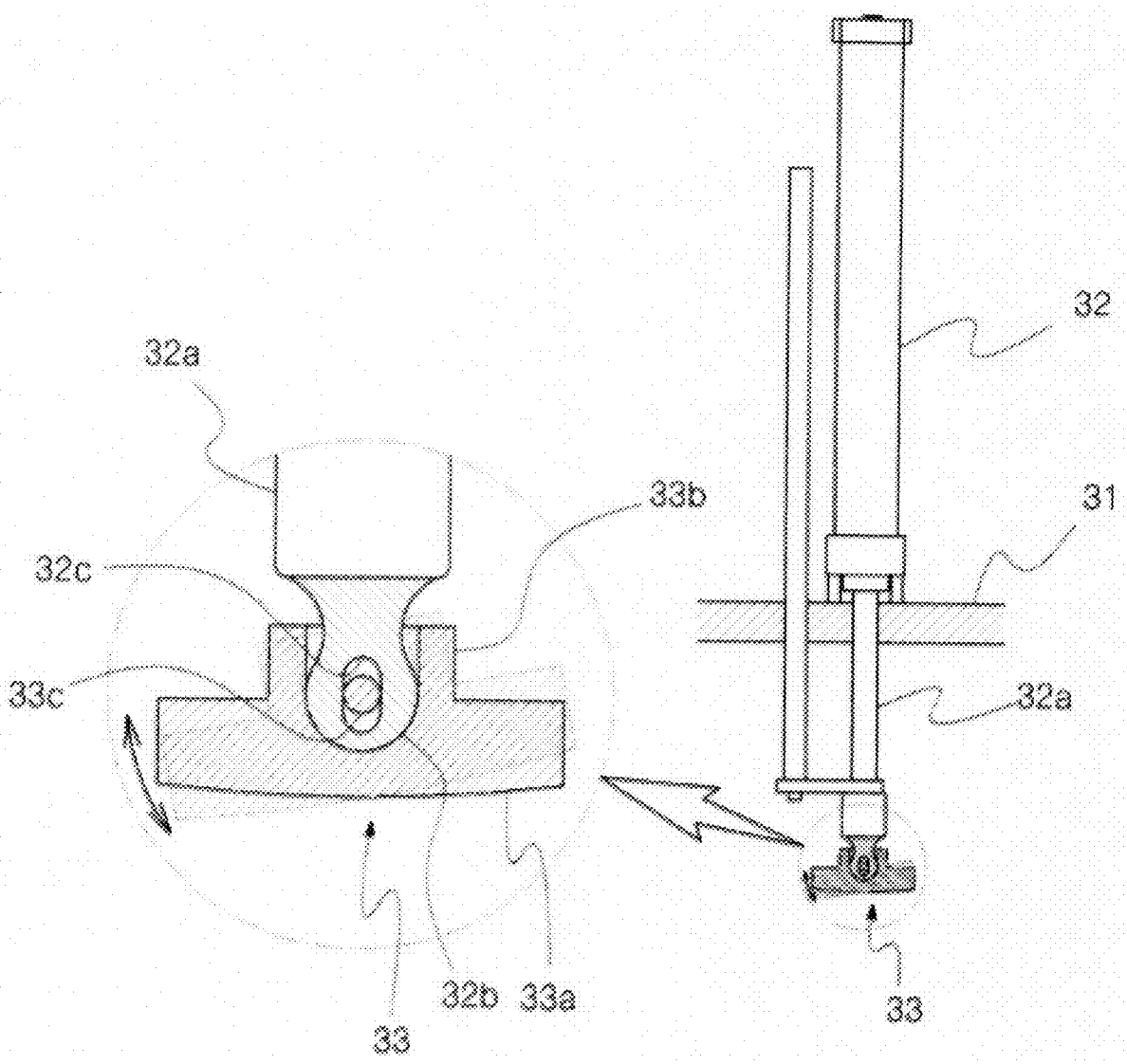
FIG. 7 is a cross-sectional view showing a pressing means of an atypical curved panel forming apparatus according to the present invention.

As shown in FIGS. 6 and 7, the pressing member 33 consist of a rectangular pressing plate 33*a* extending in the front and rear directions, an extension pipe 33*b* extending upward from the upper surface of the pressing plate 33*a* and into which the ball head 32*b* is inserted, and a fixing pin 33*c* penetrating the through hole 32*c* of the ball head 32*b* and having both ends fixed to the extension pipe 33*b*.

The upper surface of the pressing plate 33*a* forms a plane, and the lower surface forms an arc shape in which the middle portion protrudes downward.

The extension pipe 33*b* is formed in the form of a circular pipe extended in the vertical direction, and is positioned to be close to the proximal end of the pressing plate 33*a* on the upper surface of the pressing plate 33*a*.

At this time, the inner lower surface of the extension pipe 33*b* is concavely rounded downward to correspond to the diameter of the ball head 32*b*.

The fixing pin 33*c* is configured such that the diameter of the fixing pin 33*c* corresponds to the front and rear width of the through hole 32*c*, so that the pressing member 33 is not rotated in the lateral direction while being inclined in the front and the right and left and right directions.

Thus, as shown by the solid line if FIG. 6, when the piston rod 32*a* of the cylinder tool 32 is risen, the pressing member 33 inclines so that the top-end part is downwardly directed. As shown by the dotted line in FIGS. 6 and 7, when the piston rod 32*a* is descended and the pressing member 33 press the panel A put on the upper side of the mold block 20, the above pressing member 33 is properly tilted forward and backward and left and right, so that the panel A is deformed to the shape of the upper surface of the mold block 20.

A method of forming the panel A using an atypical curved panel forming apparatus constructed as above will be described as follows.

First, a panel A is arranged on the upper surface of the mold block 20, and a mold block 20 on which the panel A is arranged is supplied to a heating furnace 11 to heat the mold block 20 to an appropriate temperature.

At this time, the panel A is heated with the temperature in which the panel A is appropriately emulsified.

For example, in the case of the steel panel A, the temperature of the panel A is heated to 800-850° C., and in the case of the panel A made of another material, the temperature to be heated is appropriately changed according to the material.

The panel A and the mold block 20 heated by the heating furnace 11 are supplied to the lower side of the pressing means 30 by the conveyor apparatus 12.

Figure 9:
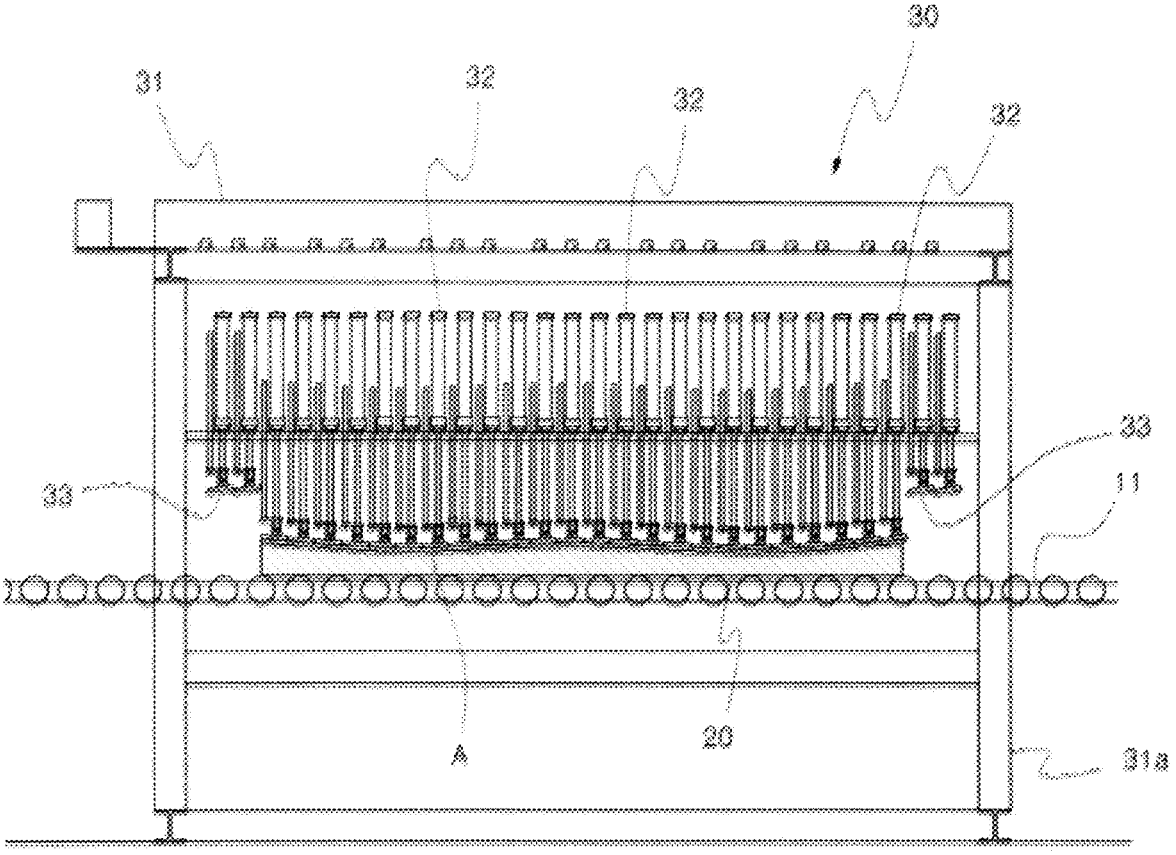
FIG. 9 is a view showing the operation of an atypical curved panel forming apparatus according to the present invention.
Figure 10:
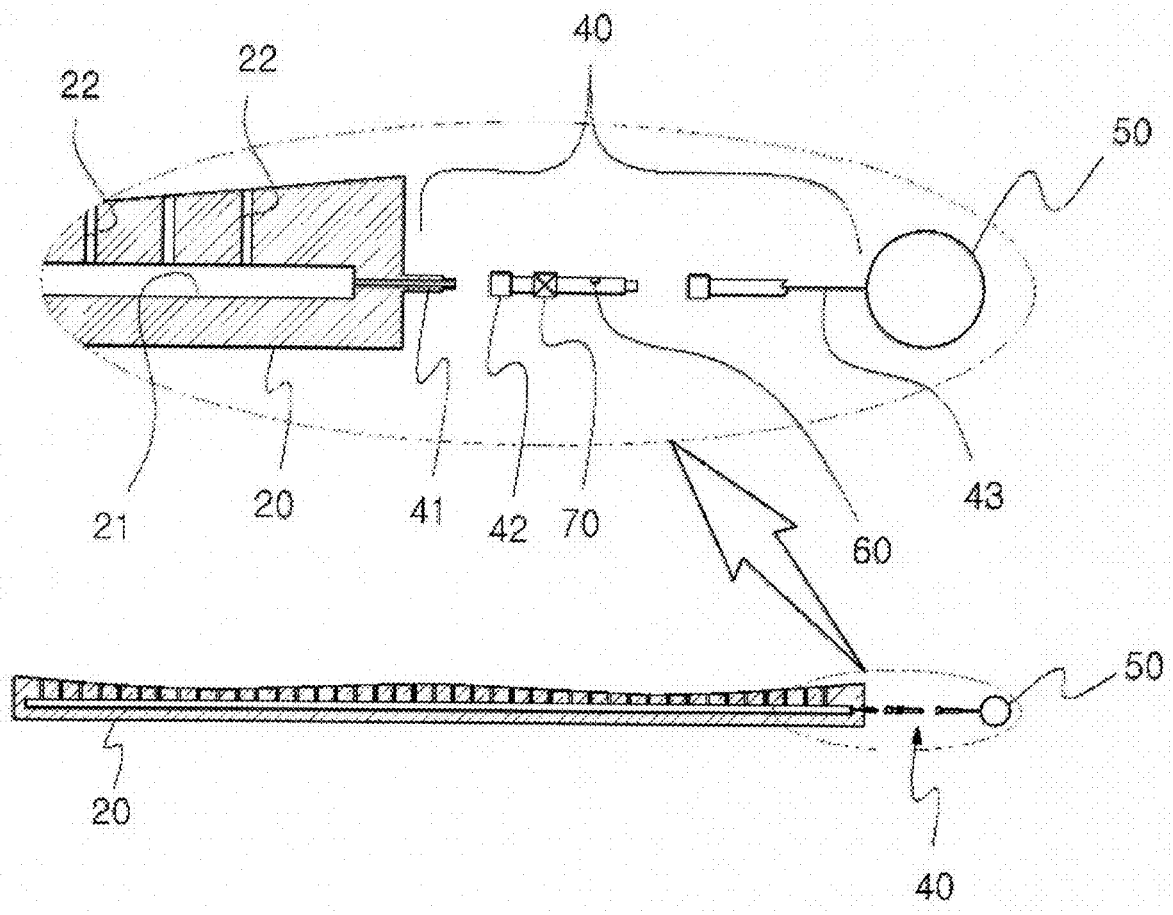
FIG. 10 is a side cross-sectional view of a second embodiment of an atypical curved panel forming apparatus according to the present invention.
Figure 11:
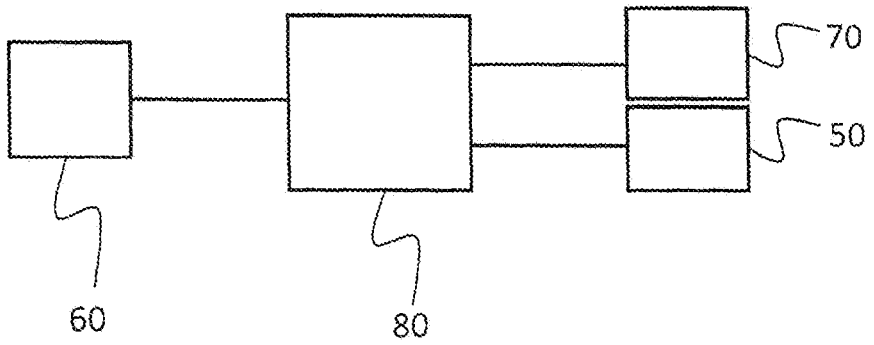
FIG. 11 is a circuit diagram of a second embodiment of an atypical curved panel forming apparatus according to the present invention.

When the panel A and the mold block 20 are supplied to the lower side of the pressing means 30, as shown in FIG. 9, the cylinder tool 32 of the pressing means 30 is operated to lower the pressing member 33, thereby allowing the panel A to be deformed to the shape of the upper surface of the mold block 20 by pressing the panel A to be in close contact with the upper surface of the mold block 20.

When the proper time elapses, the pressing member 33 is lifted by the cylinder tool 32, and the conveyor device 12 discharges the panel A and the mold block 20 backward, air-cools the discharged mold block 20 and the panel A in air, and then separates the panel A from the mold block 20 when the air-cooling is completed, thereby obtaining the panel A molded in an atypical curved shape.

The apparatus for forming an atypical curved panel configured as described above comprises: a mold block 20 which is configured to lift a panel A to be formed on an upper surface, and a pressing unit 30 which is located on the upper side of the middle portion of the conveyor device 12 and presses the panel A mounted on the mold to the lower side, and the upper surface of the mold block 20 is formed in the form of an atypical curved surface for forming the panel A. The pressing means 30 is comprising of a support 31 positioned above the mold block 20; a plurality of cylinder tools 32 provided on the support 31 to allow the piston rod 32*a* to extend downward and configured to lift the piston rod 32*a* by pneumatic or hydraulic pressure; a pressing member 33 provided at the lower end of the piston rod 32*a* of the cylinder tools 32, and the cylinder tools 32 is provided to be spaced apart from each other in the fore and aft and left and right directions. When the piston rod 32*a* is lowered, the pressing member 33 presses the panel A mounted on the upper surface of the mold block 20 to be in close contact with the upper surface of the mold block 20, so that the panel A is formed in the shape of the upper surface of the mold block 20.

Therefore, the entire panel A can be pressed at a time, so that the entire panel A can be pressurized with a constant pressure, and the time required for forming the panel A can be minimized.

In particular, since the entire panel A is simultaneously pressed and molded, there is no need for a chamber to prevent the panel A from being cooled, thereby reducing costs of the atypical curved panel forming apparatus.

In addition, the panel A is heated by passing through the heating furnace 11 while the panel A is mounted on the upper surface of the mold block 20, and is supplied to the lower side of the pressing means 30 by the conveyor device 12, thereby facilitating the transfer of the heated mold block 20 and the panel A.

In addition, a spherical ball head 32*b* is provided at a lower end of the piston rod 32*a*, the ball head 32*b* is provided with a through hole 32*c* passing through both sides thereof. The pressing member 33 is comprised of a rectangular pressing plate 33*a* extended in the forward and backward direction; an extended pipe body 33*b* extended upward from the upper surface of the pressing plate 33*a* and into which the ball head 32*b* is inserted; a fixing pin 33*c* passing through the through hole 32*c* of the ball head 32*b* and has both ends fixed to the extension pipe 33*b*. Accordingly, the pressing member 33 can be freely tilted forward and backward and left and right directions in the shape of the upper surface of the mold block 20, so that the panel A can be formed in the shape of the upper surface of the mold block 20.

In addition, the lower side of the pressing plate 33 an is configured to have an arcuate shape in which the middle portion protrudes downward, and the extension pipe body 33*b* is positioned to be close to the proximal end of the pressing plate 33*a* so that when the piston rod 32 an is raised, the front end portion of the pressing member 33 is rotated downward.

Therefore, when the pressing member 33 is lowered by the cylinder tool 32, the front end portion of the pressing member 33 is first closely adhered to the panel A, and then the front end portion of the pressing member 33 is rotated upward according to the lowering of the pressing member 33, so that the panel A is pressed against the upper surface of the mold block 20. Therefore, the panel A can smoothly adhere to the upper surface of the mold block 20.

In addition, the through hole 32*c* is formed in a slot hole type shape extending in the vertical direction, and the diameter of the fixing pin 33*c* is configured to correspond to the front and rear width of the through hole 32*c*, so that the pressing member 33 is not rotated in the lateral direction while being inclined in the front and rear and left and right directions.

Therefore, it has the advantage of preventing the pressing member 33 raised by the cylinder tool 32 from being circulated to the later direction and being mutually interfered with each other.

FIGS. 10 to 14 show another embodiment of the present invention, in which a space 21 is formed in the mold block 20, and a plurality of suction holes 22 connected to the space 21 are formed on the upper surface of the space 21.

The apparatus further includes the vacuum pump 50 which is connected to the space 21 through the exhaust pipe 40 and inhales the air on the upper surface of the mold block 20 through the space 21 and the inlet hole 22; an air pressure sensor 60 provided at an intermediate portion of the exhaust pipe 40 to measure air pressure inside the exhaust pipe 40; an exhaust valve 70 provided at an intermediate portion of the exhaust pipe 40 to open and close an intermediate portion of the exhaust pipe 40; and a control means 80 for receiving a signal from the pressure sensor 60 and controlling the operation of the vacuum pump 50 and the exhaust valve 70.

Then, the above exhaust pipe 40 is composed of the fixing pipe part 41 made of metal material and fixed to one side of the mold block 20 so as to be connected to the space 21; the intermediate pipe part 42 detachably connected to the outer end of the fixing pipe part 41 and including an air pressure sensor 60 and an exhaust valve 70 in the middle part; and the connection pipe part 43 detachably coupled to the outer end of the fixing pipe part 41 and connected to the vacuum pump 50, thereby selectively connecting the intermediate pipe part 42 and the connection pipe part 43 to the fixing pipe part 41.

The control means 80 is configured to receive a signal from the pressure sensor 60 and control the operation of the vacuum pump 50 and the exhaust valve 70 when the panel A mounted on the upper surface of the mold block 20 is pressed using the pressing means 30, wherein an input means is provided to enable the operator to input a control command.

A method of forming the panel A using an atypical curved panel forming apparatus constructed as above will be described as follows.

Figure 12:
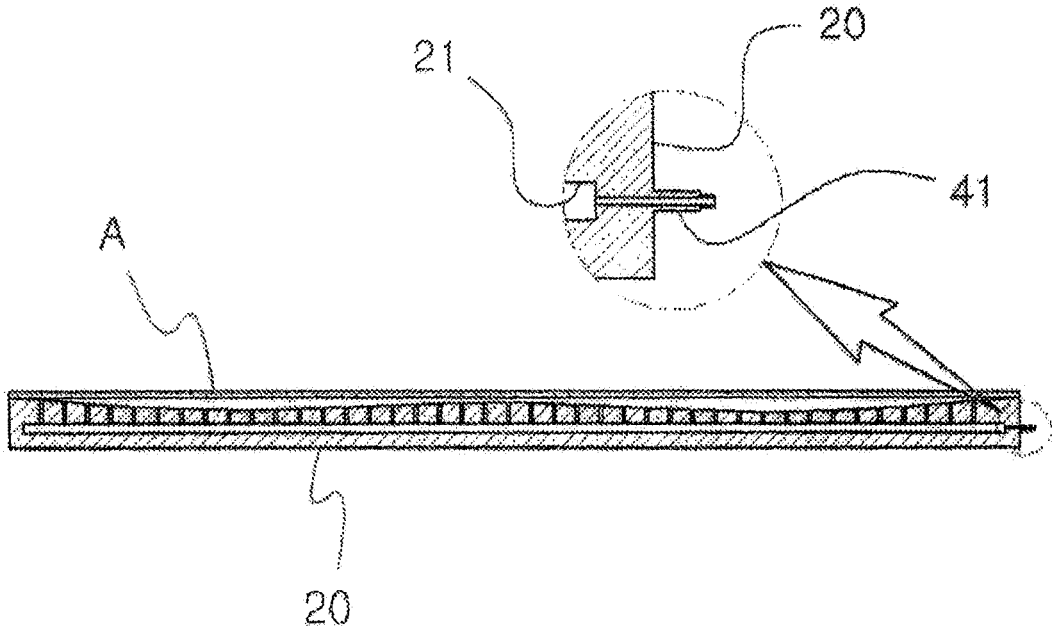
FIGS. 12 to 14 are reference diagrams illustrating the operation of a second embodiment of an atypical curved panel forming apparatus according to the present invention.

First, when the mold block 20 and the panel A are supplied to the heating furnace 11 and heated, as shown in FIG. 12, the intermediate pipe portion 42 and the connection pipe portion 43 of the exhaust pipe 40 are separated.

Then, the mold block 20 and the panel A heated by the heating furnace 11 are supplied to the pressing means 30 using the conveyor apparatus 12.

Figure 13:
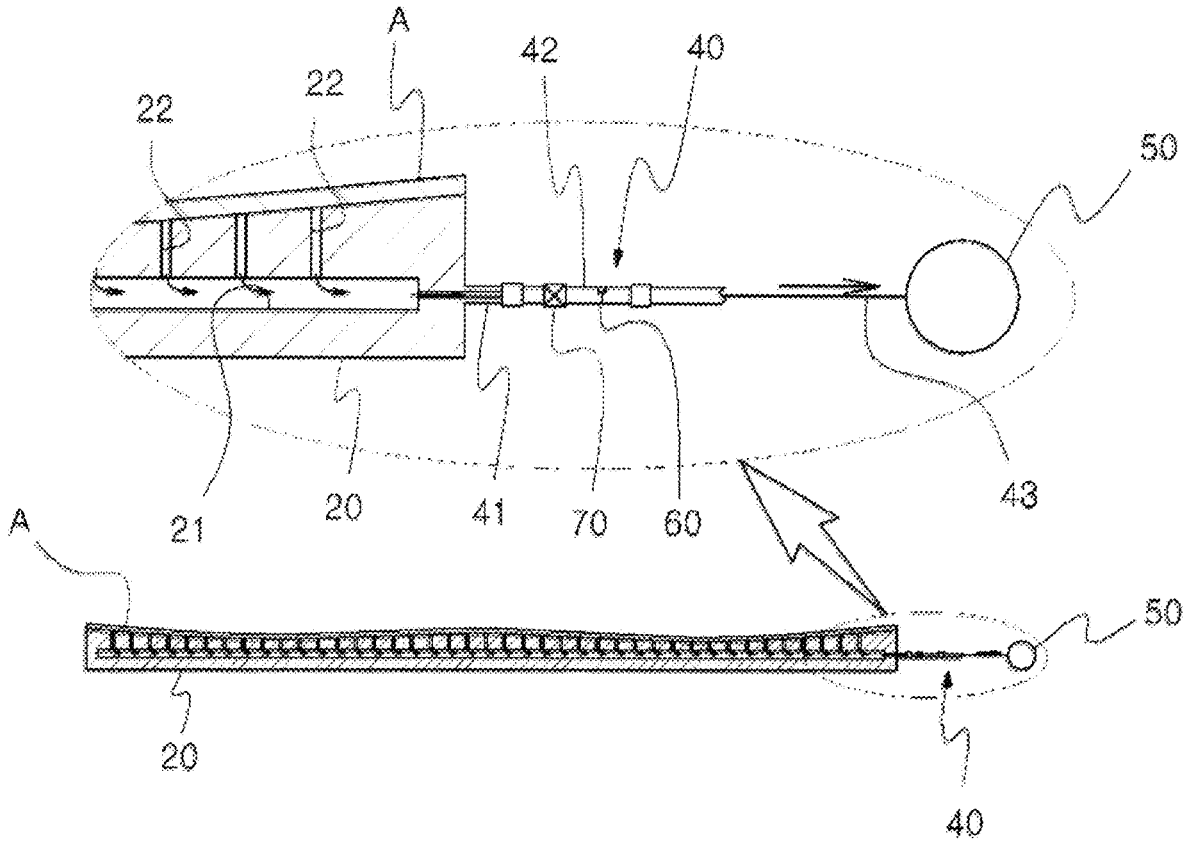

At this time, as shown in FIG. 13, the operator sequentially connects the intermediate pipe part 42 and the connection pipe part 43 to the fixing pipe part 41 so that the vacuum pump 50 is connected to the space part 21 of the mold block 20.

When the panel A mounted on the mold block 20 is pressed and molded using the pressing unit 30, the control unit 80 drives the vacuum pump 50 to inhale the air on the upper side of the mold block 20 and discharge the air to the outside, as shown by a dotted line in FIG. 13, so that the panel A pressurized by the pressing unit 30 is adsorbed and fixed on the upper surface of the mold block 20.

Then, the control unit 80 measures the air pressure inside the exhaust pipe 40 using the pressure sensor 60. When the air pressure inside the exhaust pipe 40 measured by the atmospheric pressure sensor 60 is lowered below a preset vacuum pressure, the above control means 80 controls the exhaust valve 70 to seal the middle portion of the intermediate pipe portion 42 and stops the operation of the vacuum pump 50, so that the air pressure inside the space portion 21 is maintained at a predetermined vacuum pressure, and the panel A is held in an adsorption fixed state on the upper surface of the mold block 20.

Figure 14:
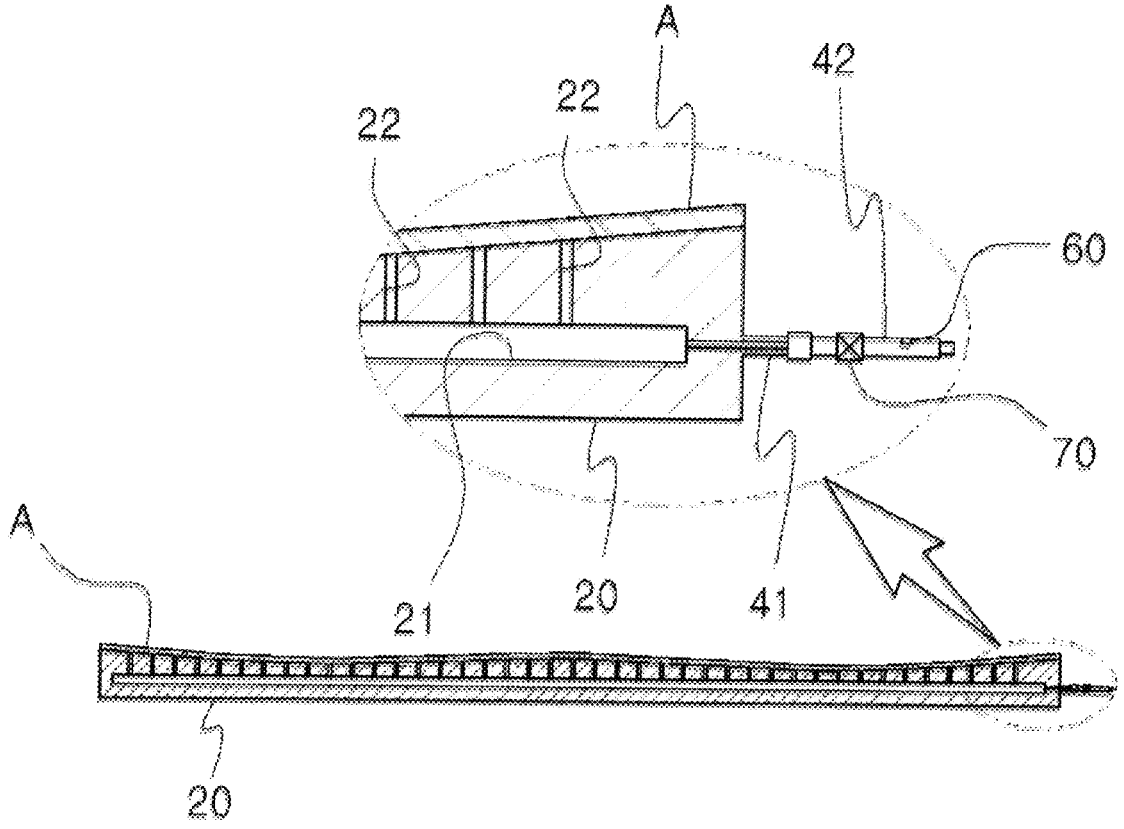

When the process of pressing and molding the panel A using the pressing means 30 is completed, the pressing member 33 is lifted. As shown in FIG. 14, when the operator releases the connection pipe part 43 and the vacuum pump 50 and the mold block 20 are disconnected, the conveyor device 12 is driven to discharge the mold block 20 and the panel A backward.

At this time, the state where the intermediate pipe part 42 is connected at the fixing pipe part 41 is maintained and the state where the exhaust valve 70 equipped in the intermediate pipe part 42 is closed is maintained. Accordingly, even if the mold block 20 and the panel A are discharged to the rear side of the pressing unit 30, the panel A mounted on the upper surface of the mold block 20 remains fixed to the upper surface of the mold block 20.

When the panel A is completely cooled, if the operator inputs a release command by operating the input switch included in the control unit 80, the control unit 80 releases the sealing of the exhaust valve 70. Accordingly, the external air is introduced into the space 21 through the intermediate pipe unit 42 and the fixing pipe unit 41, thereby releasing the fixing of the panel A.

Therefore, the panel A mounted on the mold block 20 can be lifted by an operator to manufacture the panel A molded as an atypical curved surface.

The apparatus for forming an atypical curved panel configured as above has the advantage that when the panel A is closely adhered to the upper surface of the mold block 20 using the pressing means 30, the panel A is fixed in the upper side of the molding block using the vacuum pump 50. In that way, even if the pressing member 33 of the pressing means 30 is raised, the state where the panel A adheres closely to the upper side of the molding block 20 is maintained. Accordingly, the time for adhering the panel A to the mold block 20 is minimized by using the pressing member 33, and thus the working time can be further shortened.

That is, if the panel A is immediately increased after the panel A is brought into close contact with the mold block 20 using the pressing member 33, the panel A may not be formed in a precise shape by the elasticity of the panel A since the panel A is separated from the mold block 20 by the elasticity of the panel A.

Therefore, in the above-described embodiment, after pressing the panel A using the pressing member 33, the pressing member 33 must be pressed against the panel A for an appropriate time, thereby increasing the time required for forming the panel A using the pressing means 30.

However, in the present embodiment, since the panel A pressurized by the pressing member 33 is closely fixed to the upper surface of the mold block 20 by vacuum pressure, the time for pressing the panel A using the pressing member 33 can be reduced, thereby reducing the time required for forming the panel A and improving productivity.

In particular, the exhaust pipe 40 consists of the fixing pipe part 41 made of a metal material and fixed to the one side of mold block 20 to be connected to the space 21; the intermediate pipe part 42 detachably connected to the outer end of the fixing pipe part 41 and composed of the atmospheric pressure sensor 60 and exhaust valve 70; and the connection pipe part 43 detachably connected to the outer end of the fixing pipe part 41 and connected with the vacuum pump 50. When heating the panel A and the mold block 20, the intermediate pipe part 42 and the connection pipe part 43 are separated to prevent the air pressure sensor 60 and the exhaust valve 70 from being damaged by heat, when cooling the panel A after the molding process of the panel A is completed only the connection pipe part 43 can be separated so that the mold block 20 and the panel A can be freely moved, and the exhaust pipe 40 can be maintained in a closed state.

While the invention has been described with reference to the embodiments shown in the drawings, it will be understood by those skilled in the art that various modifications and equivalent embodiments can be made therefrom. Therefore, it is intended that the present invention covers the modifications and variations of this invention provided they come within the scope of the appended claims.

INDUSTRIAL APPLICABILITY

While this invention has been particularly shown and described with reference to preferred embodiments thereof, it will be understood by those skilled in the art that various changes in form and details may be made therein without departing from the spirit and scope of the invention as defined by the appended claims.

The invention claimed is:

1. An apparatus for forming an atypical curved panel comprising:

a conveyor device;

a mold block configured to receive a panel to be formed on an upper surface and transferred by the conveyor device, the upper surface of the mold block being in the form of an atypical curved surface for forming the panel;

a press unit located on the upper side of a middle position of the conveyor device for pressing the panel mounted on the mild block downward; and pressing means comprising a support positioned above the mild block, a plurality of cylinder tools provided on the support, each said cylinder tool including a piston rod extending downward and being configured to lift the piston rod extending downward therefrom by pneumatic or hydraulic pressure, and a pressing member provided at a lower end of the piston rod of each of said cylinder tools, the cylinder tools being spaced apart from each other in fore and aft and left and right directions;

wherein, when the piston rod is lowers, the pressing member presses the panel mounted on the upper surface of the mild block to be in close contact with the upper surface of the mold block, so that the panel is formed in the shape of the upper surface of the mild block;

wherein a spherical ball head is provided at the lower end of the piston rod, the ball head is provided with a through hole passing through both sides thereof;

wherein the pressing member comprises a rectangular pressing plate extending in a forward and backward direction and having an upper surface, an extended pipe body extends upward from the upper surface of the pressing plate and into which the ball head is inserted, and a fixing pin passing though the through hold of the ball head and having both ends fixed to the extension pipe;

wherein the pressing member can be freely tilted forward and backward and in left and right directions; and wherein the through hole has a slot hole type shape extending in a vertical direction, and the diameter of the fixing pin corresponding to a front and rear width of the through hole, so that the pressing member is not rotated in a lateral direction while being included in the front and rear and left and right directions.

2. A method for forming an atypical curved panel using an atypical curved panel molding apparatus as claimed in claim 1, the method comprising the steps of: placing the panel on the upper surface of said mold block; supplying the panel placed on the said mold block to a heating furnace and heating said panel; supplying said mold block and the panel, heated in the heating furnace, to the lower side of the pressing unit by using the conveyor device; forming the panel by operating the cylinder tools of the pressing unit and descending said pressing member so as to press the panel to be in contact with the upper surface of said mold block; and discharging the panel and said mold block rearward using the conveyor device after the pressing member is lifted by the cylinder tool, and air-cooling the discharged mold block and the panel in air.

3. An apparatus for forming an atypical curved panel comprising:

a conveyor device;

a mold block configured to receive a panel to be formed on an upper surface and transferred by the conveyor device, the upper surface of the mold block being in the form of an atypical curved surface for forming the panel;

a press unit located on the upper side of a middle position of the conveyor device for pressing the panel mounted on the mild block downward; and pressing means comprising a support positioned above the mild block, a plurality of cylinder tools provided on the support, each said cylinder tool including a piston rod extending downward and being configured to lift the piston rod extending downward therefrom by pneumatic or hydraulic pressure, and a pressing member provided at a lower end of the piston rod of each of said cylinder tools, the cylinder tools being spaced apart from each other in fore and aft and left and right directions;

wherein, when the piston rod is lowers, the pressing member presses the panel mounted on the upper surface of the mild block to be in close contact with the upper surface of the mold block, so that the panel is formed in the shape of the upper surface of the mild block;

wherein a spherical ball head is provided at the lower end of the piston rod, the ball head is provided with a through hole passing through both sides thereof;

wherein the pressing member comprises a rectangular pressing plate extending in a forward and backward direction and having an upper surface, an extended pipe body extends upward from the upper surface of the pressing plate and into which the ball head is inserted, and a fixing pin passing though the through hold of the ball head and having both ends fixed to the extension pipe;

wherein the pressing member can be freely tilted forward and backward and in left and right directions;

the apparatus further comprising:

a space formed in the mold block, and a plurality of suction holes connected to the space formed on the upper surface of the space; and a vacuum pump connected to said space formed in the mold block through an exhaust pipe for inhaling the air on the upper surface of the mold block through said space formed in the mold block and the suction holes, an air pressure sensor provided at an intermediate portion of the exhaust pipe to measure air pressure inside the exhaust pipe, an exhaust valve provided at an intermediate portion of the exhaust pipe to open and close an intermediate portion of the exhaust pipe, and a controller for receiving a signal from the pressure sensor and controlling the operation of the vacuum pump and the exhaust valve;

wherein the exhaust pipe is composed of a fixing pipe part made of metal material and fixed to one side of the mold block so as to be connected to said space formed in the mold block, an intermediate pipe part detachably connected to the outer end of the fixing pipe part and including the air pressure sensor and the exhaust valve in a middle part of the intermediate pipe part, an outer end, and a connection pipe part detachably coupled to said outer end of the fixing pipe part and connected to the vacuum pump;

wherein, when the panel mounted on the mold block is pressed and molded using the pressing unit, said controller drives the vacuum pump to discharge the air from the space between the panel and the upper surface of the mold block, so that the panel is adsorbed and fixed on the upper surface of the mild block by the pressing unit, and, when the air pressure inside the exhaust pipe, measured by the pressure sensor, is lowered below a preset vacuum pressure, said controller controls the exhaust valve to seal the middle portion of the intermediate pipe portion and stops the operation of the vacuum pump; and wherein, when the mold block and the panel are heated, the intermediate tube portion and the connection pipe section are separated, when pressing and molding the panel with the pressing means, the intermediate tube portion and the connection pipe section are connected to the fixing tube part so as to discharge the upper air of the mild block when the molding process of the panel is completed and cool the panel, the connection pipe section is only separated and the state where the panel is absorbed and fixed in the upper side of the mold block with the vacuum pressure is maintained, and the intermediate pipe unit is opened by controlling the exhaust valve after the panel is completely cooled, and the outside air is introduced into the space unit through the intermediate pipe unit and the fixing pipe unit to separate the panel.

4. A method for forming an atypical curved panel using an atypical curved panel molding apparatus as claimed in claim 3, the method comprising the steps of: placing the panel on the upper surface of said mold block; supplying the panel placed on said mold block to a heating furnace and heating said panel; supplying said mold block and the panel, heated in the heating furnace, to the lower side of the pressing unit by using the conveyor device; forming the panel by operating the cylinder tools of the pressing unit and descending said pressing member so as to press the panel to be in contact with the upper surface of said mold block; and discharging the panel and said mold block rearward using the conveyor device after the pressing member is lifted by the cylinder tool, and air-cooling the discharged mold block and the panel in air.

* * * * *